US012808385B2

(12) United States Patent
Mayot

(10) Patent No.: US 12,808,385 B2
(45) Date of Patent: Nov. 24, 2026

(54) FAN FOR A MOTOR VEHICLE

(71) Applicant: MAHLE International GmbH, Stuttgart (DE)

(72) Inventor: Florian Mayot, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 19/357,771

(22) Filed: Oct. 14, 2025

(65) Prior Publication Data

US 2026/0104058 A1 Apr. 16, 2026

(30) Foreign Application Priority Data

Oct. 15, 2024 (DE) ..... 102024129869.3

(51) Int. Cl.

| | |
|---|---|
| ***F04D 29/16*** | (2006.01) |
| ***F04D 25/08*** | (2006.01) |
| ***F04D 29/32*** | (2006.01) |
| ***F04D 29/52*** | (2006.01) |
| ***F04D 29/66*** | (2006.01) |
| *F04D 19/00* | (2006.01) |

(52) U.S. Cl.

CPC ..... *F04D 29/164* (2013.01); *F04D 25/08* (2013.01); *F04D 29/326* (2013.01); *F04D 29/526* (2013.01); *F04D 29/667* (2013.01); *F04D 19/002* (2013.01)

(58) Field of Classification Search

CPC ..... F04D 29/164; F04D 25/08; F04D 29/326; F04D 29/526; F04D 29/667

See application file for complete search history.

(56) References Cited

U.S. PATENT DOCUMENTS

| | | | | |
|---|---|---|---|---|
| 5,769,607 | A | 6/1998 | Neely et al. | |
| 6,431,498 | B1 | 8/2002 | Watts et al. | |
| 6,874,990 | B2 * | 4/2005 | Nadeau | F04D 29/164 415/173.5 |
| 7,762,769 | B2 * | 7/2010 | Stevens | F04D 29/326 416/189 |
| 7,794,204 | B2 * | 9/2010 | Stevens | F04D 29/386 416/189 |
| 9,046,110 | B2 | 6/2015 | Teroaka et al. | |
| 9,228,591 | B2 | 1/2016 | Choi | |
| 9,249,788 | B2 * | 2/2016 | Kimura | F04B 17/03 |
| 10,718,340 | B2 | 7/2020 | Takahashi et al. | |

(Continued)

FOREIGN PATENT DOCUMENTS

| | | |
|---|---|---|
| CN | 110701100 | 1/2020 |
| DE | 2102161 | 8/1972 |

(Continued)

OTHER PUBLICATIONS

Search Report from DE agglication No. 102024129866.9 (Jul. 15, 2025).

(Continued)

*Primary Examiner* — Eldon T Brockman

(74) *Attorney, Agent, or Firm* — Barnes & Thornburg

(57) ABSTRACT

A fan for a motor vehicle that has a fan wheel and a support frame is provided. The fan wheel has an outer ring with a rim, and the frame has a rim segment with at least one recess that forms a pocket. The at least one recess is at least partially axially opposite and opens toward the rim on the outer ring.

17 Claims, 3 Drawing Sheets

(56) References Cited

U.S. PATENT DOCUMENTS

| | | | | |
|---|---|---|---|---|
| 10,844,770 | B2 * | 11/2020 | Hong | B60K 11/02 |
| 11,142,038 | B2 * | 10/2021 | Stauter | B60H 1/00464 |
| 11,560,796 | B2 | 1/2023 | Gea Aguilera | |
| 2003/0161728 | A1 * | 8/2003 | Cho | F04D 29/164 415/222 |
| 2004/0156712 | A1 | 8/2004 | Nadeau | |
| 2005/0074333 | A1 | 4/2005 | Iwasaki | |
| 2010/0054931 | A1 | 3/2010 | Yoshida | |
| 2014/0093382 | A1 | 4/2014 | Fuglsang | |
| 2016/0305448 | A1 | 10/2016 | Hong | |
| 2017/0107971 | A1 | 4/2017 | Singh | |
| 2018/0119706 | A1 | 5/2018 | Vogiatzis | |
| 2020/0141418 | A1 | 5/2020 | Aiello | |
| 2022/0112901 | A1 * | 4/2022 | Mauss | F04D 29/325 |
| 2022/0316496 | A1 | 10/2022 | Froh | |
| 2023/0132350 | A1 | 4/2023 | Schneider et al. | |
| 2024/0318660 | A1 | 9/2024 | Yao et al. | |

FOREIGN PATENT DOCUMENTS

| | | | | |
|---|---|---|---|---|
| DE | 9013191 | 1/1992 | | |
| DE | 69907134 | 2/2004 | | |
| DE | 102005044294 | 4/2007 | | |
| DE | 102006023417 | 11/2007 | | |
| DE | 60222905 | 7/2008 | | |
| DE | 102013212341 | 12/2014 | | |
| DE | 102018114896 | 12/2018 | | |
| DE | 202019100367 | 4/2020 | | |
| FR | 2931908 | A1 * | 12/2009 | F04D 29/164 |
| GB | 2507493 | 5/2014 | | |
| KR | 10-2014-0119488 | 4/2013 | | |
| WO | 2005026510 | 3/2005 | | |

OTHER PUBLICATIONS

U.S. Appl. No. 19/340,258—Office Action dated Nov. 20, 2025 (17 pages).

CN202521448521.3—Examination report dated Jun. 26, 2026 and English translation.

U.S. Appl. No. 19/415,289—office action dated Aug. 17, 2026 (20 pages).

* cited by examiner

FAN FOR A MOTOR VEHICLE

CROSS-REFERENCE TO RELATED APPLICATIONS

This application claims priority from German Patent Application No. DE 10 2024 129 869.3, filed on Oct. 15, 2024, the entirety of which is hereby incorporated by reference herein.

The invention relates to a fan for a motor vehicle that has a fan wheel, and a motor vehicle with such a fan.

A fan can be used in a motor vehicle to convey air from a fresh air intake—e.g. the grille at the front—to the engine compartment. These fans normally comprise a fan wheel and a frame for the fan wheel. Turbulence in the airflow generated by the fan can create noises and have a negative impact on the fan's performance.

The object of the invention is to therefore create a better, or at least different, fan design that overcomes the disadvantages specified above.

This object is achieved with the subject matter of the independent claims. Advantageous embodiments are the subject matter of the dependent claims.

The fan obtained with the invention is intended and designed for a motor vehicle. It comprises a fan wheel that rotates about an axis and a frame for the fan wheel. The fan wheel has a circumferential outer ring spaced apart from the rotational axis, and the support frame has a circumferential rim segment spaced apart from this outer ring. The outer ring on the fan wheel has a circumferential rim that is perpendicular to and extends away from the rotational axis. The rim segment on the frame is at least partially axially opposite the rim on the outer ring. The rim segment also has at least one recess that forms a pocket, which is open toward the rim on the outer ring.

A gap is formed between the outer ring on the fan wheel and the rim segment on the frame through which air can flow in the fan obtained with the invention. This gap ensures that the fan wheel does not come in contact with the frame while it is rotating. The recesses are opposite the rim on the outer ring, such that air conveyed by the fan and flowing through the gap can be trapped therein. These recesses reduce turbulence in the air flowing through the gap. This reduces the noise generated by the fan wheel, and increases the efficiency of the fan.

The at least one recess in the rim segment can be downstream of the rim on the outer ring on the fan wheel in the airflow conveyed by and flowing through the fan.

The rim segment on the frame can have an outer wall, inner wall, and floor. The outer wall and inner wall can encircle the rotational axis, parallel thereto, and the floor can encircle the rotational axis, perpendicular thereto. The outer wall can be radially outside and spaced apart from the inner wall, and the floor can connect the outer wall to the inner wall. Consequently, a circumferential groove is formed in the rim segment on the frame, spaced apart from the rotational axis. The at least one recess in the rim segment can be in the groove and formed at least in part by the outer wall, inner wall, and floor of the rim segment on the frame.

The rim segment on the frame can also have numerous recesses. These recesses can then be distributed about the rotational axis. Adjacent recesses can be separated from one another in the groove by walls formed therein. These walls can be parallel to the rotational axis and extend radially therefrom.

The axial extension of the inner wall of the rim segment can be smaller than the axial extension of the outer wall of the rim segment. This axial extension of the inner wall can be between 15% and 95% of the axial extension of the outer wall. The radial extension of the floor of the rim segment can be between 35% and 120% of the axial extension of the inner wall. The outer wall of the rim segment on the support frame can be at least partially radially opposite the rim on the outer ring on the fan wheel.

The fan wheel in one embodiment of the fan obtained with the invention can have an inner ring that is radially inside the outer ring. The frame can then have an inner segment radially inside the rim segment. This inner segment of the frame can be at least partially axially opposite and spaced apart from the inner ring on the fan wheel. This inner segment of the frame can have at least one recess. This recess can be at least partially axially opposite the inner ring on the fan wheel and open toward it. Like the recesses in the rim segment, these recesses can also reduce turbulence in the air conveyed by the fan and flowing through the fan wheel.

By way of example, the inner segment on the support frame can have a circumferential groove with numerous recesses spaced apart from the rotational axis. The recesses can then be distributed about the rotational axis in the groove. Adjacent recesses in the groove can be separated by walls therein.

The inner ring and outer ring on the fan wheel can be connected to one another by at least one blade. The rim segment and inner segment of the frame can be connected to one another by numerous—at least two—webs. These webs can extend radially, and be connected at one end to the rim segment and/or a part of the frame next to the rim segment, and at the other end to the inner segment and/or a part of the frame next to the inner segment. In one possible embodiment of the fan, an electric motor can be attached to the inner segment on the frame. This motor can be axially adjacent to the fan wheel, and connected thereto.

In on possible embodiment of the fan, the rim on the outer ring can have a circumferential stepped indentation on the surface facing away from the recesses in the rim segment and perpendicular to the rotational axis. This indentation results in a radially outside first section of the rim that is axially thinner, and a radially inside second section that is axially thicker. In other words, the thickness of the radial extension of the rim on the outer ring may vary. This reduces the noise generated by the fan wheel and increases the efficiency of the fan.

The axial thickness of the first section of the rim can be between 25% and 90% of the axial thickness of the second section. The radial width of the first section of the rim can be between 15% and 85% of the radial width of the rim.

The invention also relates to a motor vehicle that has a fresh air intake and the fan described above, which is downstream of the air intake. The fresh air intake can be formed on the grille, and the fan is designed to convey air from this grille into the engine compartment in the motor vehicle.

In the context of the present invention, the terms, "axial," "radial," and "circumferential" always relate to the rotational axis of the fan wheel. "Axial extension/width/thickness" relates to the extension of something along the rotational axis of the fan wheel. "Radial extension/width/thickness" relates to the extension of something along a radial axis extending radially away from the rotational axis.

Other important features and advantages of the invention can be derived from the dependent claims, the drawings, and the descriptions thereof.

It is understood that the features specified above and described below can be used not only in the given combination, but also in other combinations or in and of themselves without abandoning the framework of the present invention.

Preferred exemplary embodiments of the invention are shown in the drawings, and shall be explained in greater detail below, in which the same reference symbols are used for identical, similar, and functionally identical components.

Therein, schematically:

Figure 1:
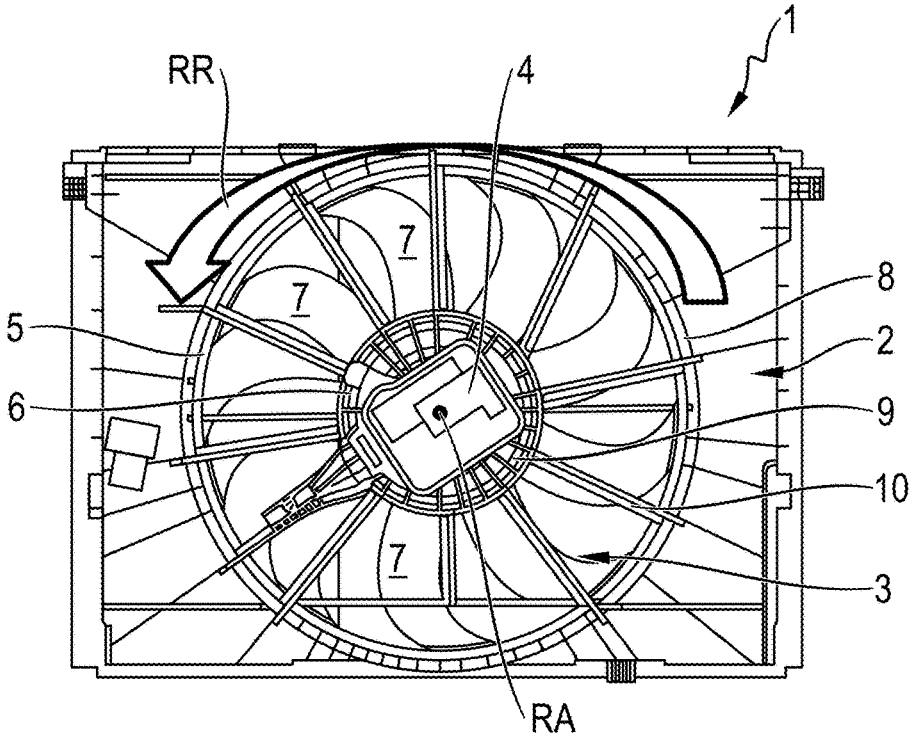
FIG. 1 shows a fan obtained with the invention that has a fan wheel and support frame.

FIG. 1 shows a fan 1 for a motor vehicle obtained with the invention. The fan 1 comprises a support frame 2 and a fan wheel 3. The fan wheel 3 is attached to the frame 2 such that it can rotate about a rotational axis RA. The fan 1 also has an electric motor 4 that is attached to the frame 2 and is connected to the fan wheel 3 in order to cause it to rotate. The arrow indicates the direction RR in which the fan wheel 3 can rotate. It can also rotate in the other direction.

The fan wheel 3 has a circumferential outer ring 5 spaced apart from the rotational axis RA, and an inner ring 6 that is radially inside the outer ring 5. The fan wheel 3 also has numerous blades 7 extending radially between the outer ring 5 and inner ring 6. The blades 7 are connected at one end to the outer ring 5 and at the other end to the inner ring 6.

The frame 2 has a circumferential rim segment 8 spaced apart from the outer ring 5 on the fan wheel 3, and an inner segment 9 radially inside the rim segment 8. The frame 2 also has numerous radial webs 10, connected at one end to the rim segment 8 and at the other end to the inner segment 9 on the frame 2.

Figure 2:
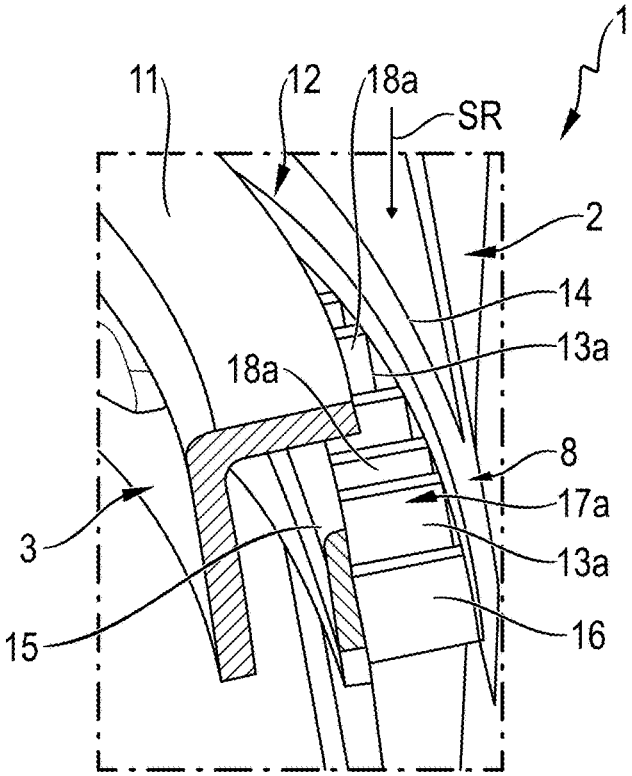
FIG. 2 shows a partial view of the fan obtained with the invention where the outer ring on the fan wheel and the rim segment on the frame are located.

FIG. 2 shows a partial view of the fan 1 obtained with the invention, where the outer ring 5 on the fan wheel 3 and the rim segment 8 of the frame 2 are located. As can be seen in FIG. 2, the outer ring 5 has a rim 11. This rim 11 is perpendicular to the rotational axis RA and faces radially outward, toward the rim segment 8 on the frame 2. The rim segment 8 on the frame 2 is partially axially opposite the rim 11 on the outer ring 5. There is a circumferential groove 17*a* encircling the rotational axis RA in the rim segment 8, and there are numerous recesses 13*a* that form pockets in the groove 17*a*, which are open toward the rim 11. These recesses 13*a* are all identical and evenly distributed about the rotational axis RA.

A gap 12 is formed between the rim segment 8 on the frame 2 and the rim 11 on the outer ring 5. This gap 12 allows the fan wheel 3 to rotate in the frame 2 without coming in contact therewith, and an airflow conveyed by and flowing through the fan 1 can flow through it in the flow direction SR. The recesses 13*a* can reduce turbulence in the air flowing through the gap 12, thus reducing the noise generated by the fan wheel 3 and increasing the efficiency of the fan 1.

Figure 3:
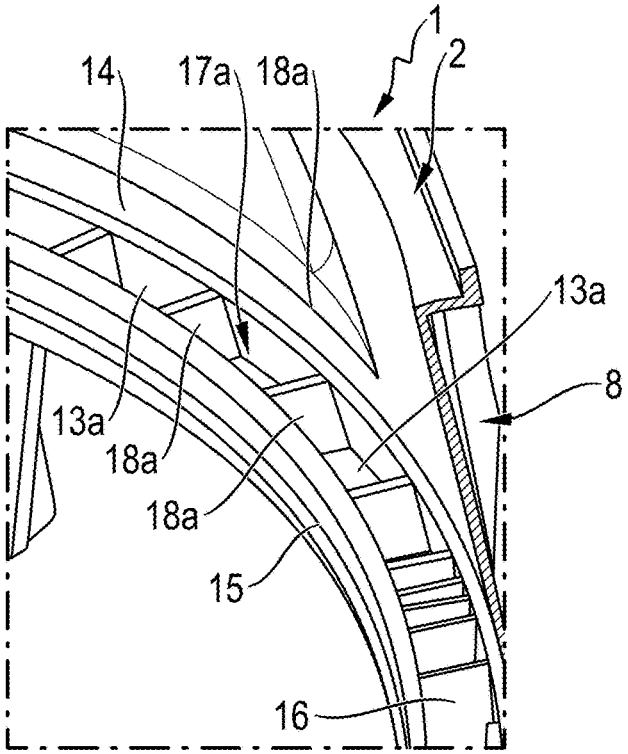
FIG. 3 shows a partial view of the support frame for the fan obtained with the invention where the rim segment is located.

FIG. 3 shows a partial view of the support frame 2 for the fan 1 obtained with the invention, in the rim segment 8. As FIG. 3 illustrates particularly well, the rim segment 8 has an outer wall 14, inner wall 15, and floor 16. The outer wall 14 and inner wall 15 encircle the rotational axis RA and are parallel thereto, with the outer wall 14 radially outside the inner wall 15. The floor 16 encircles the rotational axis RA and is perpendicular thereto. The floor 16 connects the outer wall 14 to the inner wall 15, thus forming the circumferential groove 17*a* described above. The recesses 13*a* are inside the groove 17*a* and separated from one another by walls 18*a*. The walls 18*a* are parallel to the rotational axis RA and extend radially.

Figure 4:
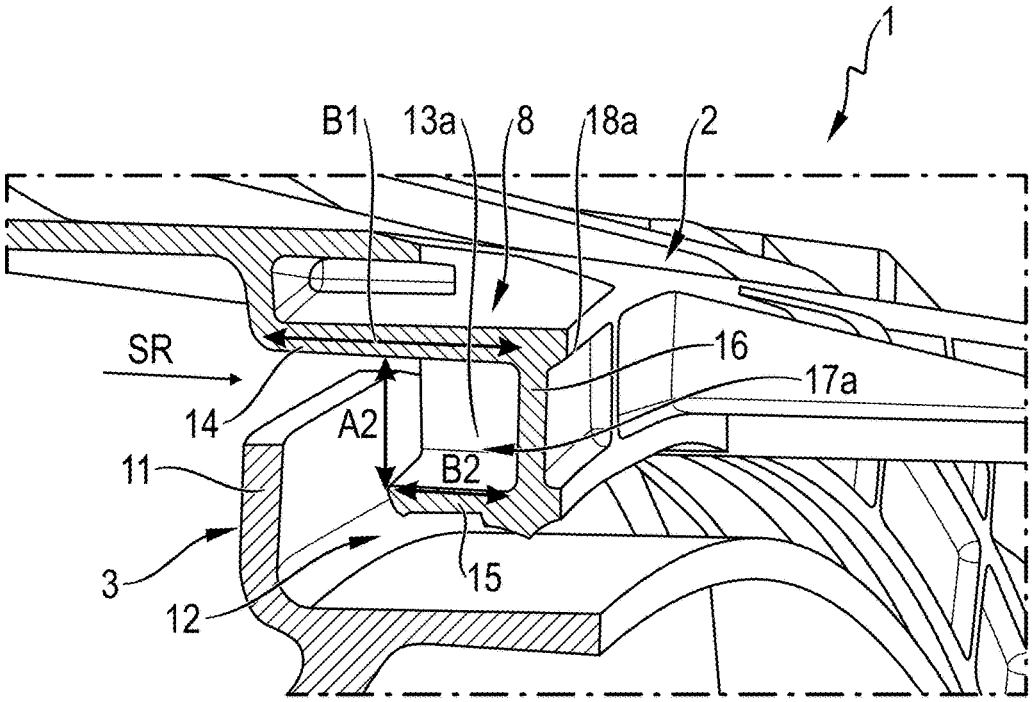
FIG. 4 shows a partial cutaway view of the fan obtained with the invention where the outer ring on the fan wheel and the rim segment on the frame are located.

FIG. 4 show a partial cutaway view of the fan 1 obtained with the invention where the outer ring 5 on te fan wheel 3 and the rim segment 8 of the frame 2 are located. FIG. 4 shows that the axial extension B2 of the inner wall 15 is smaller than the axial extension B1 of the outer wall 14. The axial extension of the inner wall 15 can be between 15% and 95% of the axial extension B1 of the outer wall 14. Furthermore, the radial extension A2 of the floor 16 can be between 35% and 120% od the axial extension B2 of the inner wall 15.

Figure 5:
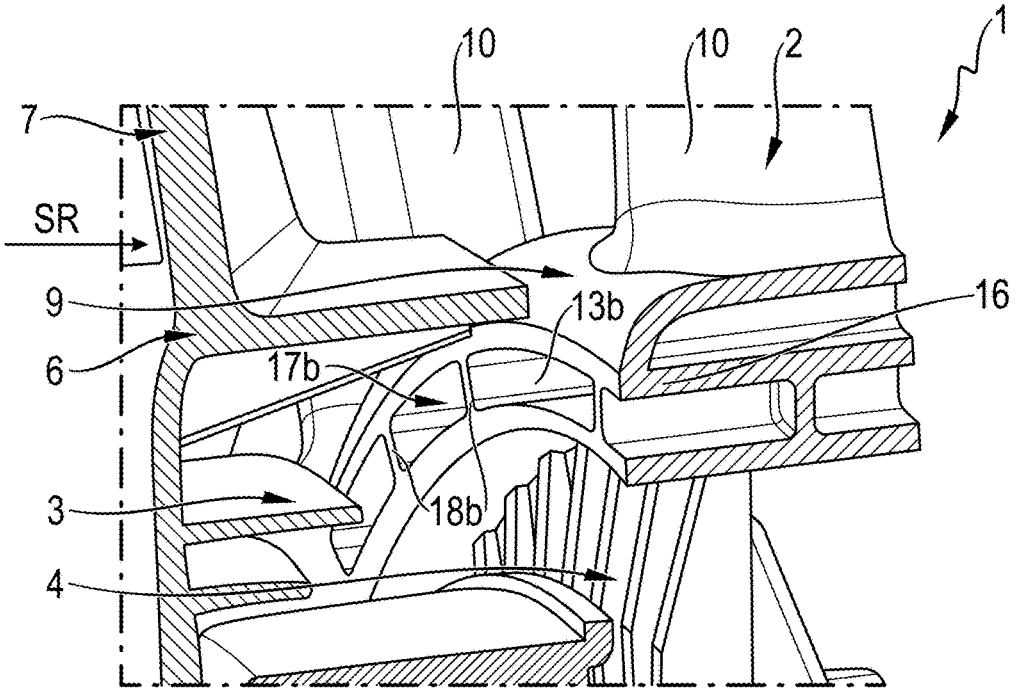
FIG. 5 shows a partial view of the fan obtained with the invention where the inner ring on the fan wheel and the inner segment segment on the frame are located.

FIG. 5 shows a partial view of the fan 1 obtained with the invention where the inner ring 6 on the fan wheel 3 and the inner segment 9 on the frame 2 are located. FIG. 5 shows that the inner segment 9 on the frame 2 has numerous recesses 13*b*, which form pockets that are open toward the inner ring 6 on the fan wheel 3. Like the rim segment 8, the inner segment 9 has a circumferential groove 17*b* containing the recesses 13*b*, which are separated by walls 18*b*. The recesses 13*b* can reduce turbulence between blades 7 in the fan wheel 3, thus reducing the noise generated by the fan wheel 3 and the fan 1.

Figure 6:
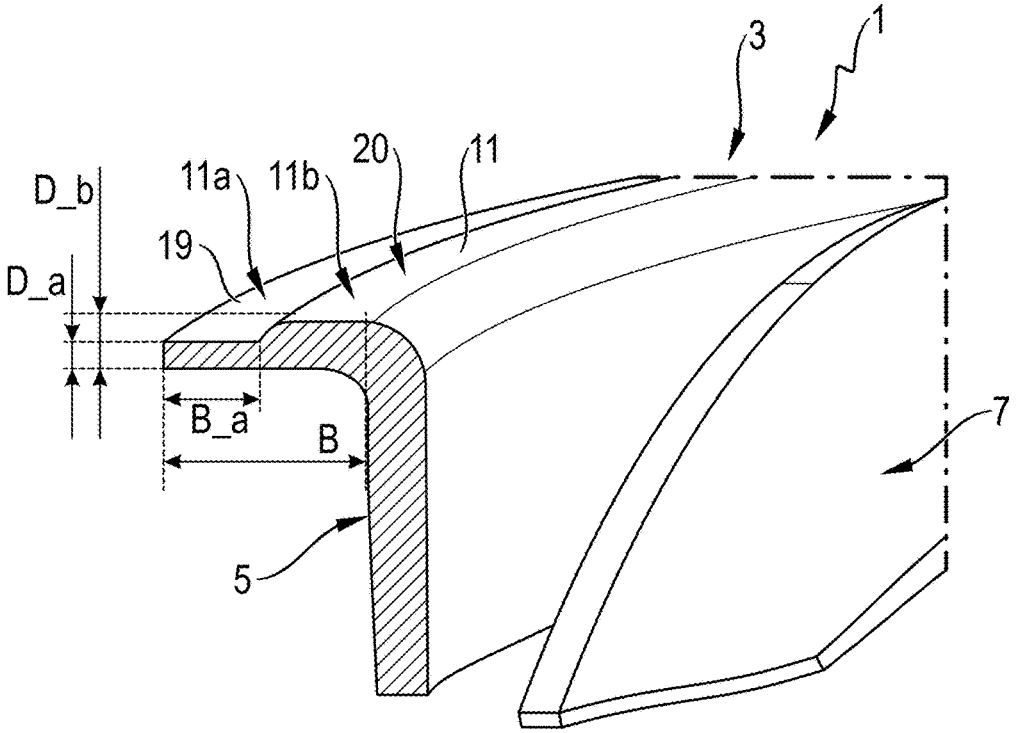
FIG. 6 shows a partial view of the outer ring on the fan wheel in the fan obtained with the invention.

FIG. 6 shows a partial view of the fan wheel 3 for the fan 1 obtained with the invention, where the outer ring 5 is located. FIG. 6 shows that the rim 11 on the outer ring 5 has an indentation 19 on the surface 20 facing away from the recesses 13*a*, forming a radially outside first section 11*a* and a radially inside second section 11*b* of the rim 11. The axial thickness D_a of the first section 11*a* is thinner than the axial thickness D_b of the second section 11*b*. The axial thickness Da can be between 25% and 90% of the axial thickness D_b. The radial width B_a of the first section 11*a* can be between 15% and 85% of the radial width B of the entire rim 11.

The specification can be readily understood with reference to the following Numbered Paragraphs:

Numbered Paragraph 1. A fan (1) for a motor vehicle, wherein the fan (1) has a fan wheel (3) that rotates about a rotational axis (RA), and a frame (2) that supports the fan wheel (3), the fan wheel (3) has a circumferential outer ring (5) spaced apart from the rotational axis (RA), and the frame (2) has a circumferential rim segment (8) spaced apart from the outer ring (5), the outer ring (5) on the fan wheel (3) has a circumferential rim (11) that is perpendicular to the rotational axis (RA) and extends outward therefrom, the rim segment (8) on the frame (2) at least partially lies axially opposite the rim (11) on the outer ring (5), and the rim segment (8) on the frame (2) has at least one recess (13*a*) that forms a pocket, which is open toward the rim (11) on the outer ring (5).

Numbered Paragraph 2. The fan (1) according to Numbered Paragraph 1, characterized in that the at least one recess (13*a*) in the rim segment (8) is downstream of the rim (11) on the outer ring (5) in the airflow conveyed by and flowing through the fan (1).

Numbered Paragraph 3. The fan (1) according to Numbered Paragraph 1 or 2, characterized in that the rim segment (8) on the frame (2) has a circumferential outer wall (14) that is parallel to the rotational axis (RA), a circumferential inner wall (15) that is parallel to the rotational axis (RA), and a circumferential floor (16) that is perpendicular to the rotational axis (RA), the outer wall (14) is radially outside and spaced apart from the inner wall (15), and the floor (16) connects the outer wall (14) to the inner wall (15), such that a circumferential groove (17*a*) is formed in the rim segment (8) on the frame (2) is spaced apart from the rotational axis (RA), and the at least one recess (13*a*) in the rim segment (8) is in the groove (17*a*).

Numbered Paragraph 4. The fan (1) according to Numbered Paragraph 3, characterized in that the rim segment (8) on the frame (2) has numerous recesses (13*a*), which are distributed evenly about the rotational axis (RA), adjacent recesses (13*a*) in the groove (17*a*) are separated by walls (18*a*) therein.

Numbered Paragraph 5. The fan (1) according to Numbered Paragraph 3 or 4, characterized in that the axial extension (B2) of the inner wall (15) of the rim segment (8) is smaller than the axial extension (B1) of the outer wall (14) of the rim segment (8), the axial extension (B2) of the of the inner wall (15) of the rim segment (8) is between 15% and 95% of the axial extension (B1) of the outer wall (14) of the rim segment (8), and/or the radial extension of the floor (16) of the rim segment (8) is between 35% and 120% of the axial extension (B2) of the inner wall (15) of the rim segment (8).

Numbered Paragraph 6. The fan (1) according to any of the Numbered Paragraphs 3 to 5, characterized in that the outer wall (14) of the rim segment (8) is at least partially radially opposite the rim (11) on the outer ring (5).

Numbered Paragraph 7. The fan (1) according to any of the preceding Numbered Paragraphs, characterized in that the fan wheel (3) has an inner ring (6) radially inside the outer ring (5), and the frame (2) has an inner segment (9) radially inside the rim segment (8), the inner segment (9) on the frame (2) is at least partially axially opposite and spaced apart from the inner ring (6) on the fan wheel (3), the inner segment (9) on the frame (2) has at least on recess (13*b*) forming a pocket therein, and this recess (13*a*) in the inner segment (9) is at least partially axially opposite and opens toward the inner ring (6) on the fan wheel (3).

Numbered Paragraph 8. The fan (1) according to Numbered Paragraph 7, characterized in that the inner segment (9) on the frame (2) has a circumferential groove (17*a*) spaced apart from the rotational axis (RA), the inner segment (9) on the frame (2) has numerous recesses (13*b*), which are distributed about the rotational axis (RA) in the groove (17*b*), and adjacent recesses (13*b*) in the groove (17*b*) are separated by walls (18*b*) therein.

Numbered Paragraph 9. The fan (1) according to any of the preceding Numbered Paragraphs, characterized in that the rim (11) on the outer ring (5) has a circumferential, stepped indentation (19) on the surface (20) facing away from the recesses (13*a*) in the rim segment (8) and perpendicular to the rotational axis (RA), and a radially outside first section (11*a*) with a thinner axial thickness (D_a) and a radially inside second section (11*b*) with a thicker axial thickness (D_b) are formed by the indentation (19) on the rim (11).

Numbered Paragraph 10. the Fan (1) According to Numbered Paragraph 7, characterized in that the axial thickness (D_a) of the first section (11*a*) of the rim (11) is between 225% and 90% of the axial thickness (D_b) of the second section (11*b*) of the rim (11), and/or the radial width (B_a) of the first section (11*a*) of the rim (11) is between 15% and 85% of the radial thickness (B) of the rim (11).

Numbered Paragraph 11. A motor vehicle that has a fresh air intake and a fan (1) according to any of the preceding Numbered Paragraphs, wherein the fan (1) is downstream of the air intake in the airflow.

LIST OF REFERENCE SYMBOLS

1 fan
2 support frame
3 fan wheel
4 motor
5 outer ring
6 inner ring
7 blade
8 rim segment
9 inner segment
10 web
11 rim
11*a*/11*b* first/second section
12 gap
13*a*/13*b* recesses
14 outer wall
15 inner wall
16 floor
17*a*/17*b* groove
18*a*/18*b* walls
19 indentation
20 surface
A2 radial extension
B/B_a radial width
B1/B2 axial extension
D_a/D_b axial thickness
RA rotational axis
RR rotational direction
SR flow direction

The invention claimed is:

1. A fan for a motor vehicle, comprising a fan wheel that rotates about a rotational axis, and a frame that supports the fan wheel, the fan wheel comprises a circumferential outer ring spaced apart from the rotational axis, and the frame comprises a circumferential rim segment spaced apart from the outer ring, the circumferential outer ring on the fan wheel comprises a circumferential rim that is perpendicular to the rotational axis and extends outward therefrom, wherein the circumferential rim segment on the frame at least partially lies axially opposite the circumferential rim on the outer ring, and the circumferential rim segment on the frame comprises at least one recess that forms a pocket, which is open toward the circumferential rim on the outer ring, wherein the fan wheel comprises an inner ring radially inside the circumferential outer ring, and the frame has an inner segment radially inside the circumferential rim segment, the inner segment on the frame is at least partially axially opposite and spaced apart from the inner ring on the fan wheel, the inner segment on the frame has a plurality of recesses that each form a pocket therein, and the plurality of recesses in the inner segment are each at least partially axially opposite and open toward the inner ring on the fan wheel.

2. The fan according to claim 1, wherein the at least one recess in the circumferential rim segment is downstream of the circumferential rim on the outer ring of the fan wheel and is disposed in the airflow conveyed by and flowing through the fan wheel when the fan is operating.

3. The fan according to claim 1, wherein the circumferential rim segment on the frame comprises a circumferential outer wall that is parallel to the rotational axis, a circumferential inner wall that is parallel to the rotational axis, and a circumferential floor that is perpendicular to the rotational axis, wherein the outer wall is radially outside and spaced apart from the inner wall, and the floor connects the outer wall to the inner wall, such that a circumferential groove is formed in the circumferential rim segment on the frame and is spaced apart from the rotational axis, and wherein the at least one recess in the circumferential rim segment is in the groove.

4. The fan according to claim 3, wherein the circumferential rim segment on the frame has a plurality of recesses that are distributed evenly about the rotational axis, wherein adjacent recesses that are in the groove are separated by walls therein.

5. The fan according to claim 3, wherein an axial extension of the inner wall of the circumferential rim segment is smaller than an axial extension of the outer wall of the circumferential rim segment, the axial extension of the of the inner wall of the circumferential rim segment is between 15% and 95% of the axial extension of the outer wall of the circumferential rim segment, and/or the radial extension of the floor of the circumferential rim segment is between 35% and 120% of the axial extension of the inner wall of the circumferential rim segment.

6. The fan according to claim 3, wherein the outer wall of the circumferential rim segment is at least partially radially opposite the rim on the circumferential outer ring.

7. The fan according to claim 1, wherein the inner segment on the frame comprises a circumferential groove spaced apart from the rotational axis, the inner segment on the frame has a plurality of recesses that are distributed about the rotational axis in the groove, and adjacent recesses in the groove are separated by walls therein.

8. The fan according to claim 1, wherein the circumferential rim on the circumferential outer ring of the fan wheel has a circumferential, stepped indentation on the surface facing away from the recesses in the circumferential rim segment and perpendicular to the rotational axis, the stepped indentation is at a constant geometry around the circumference of the circumferential rim and a radially outside first section with a thinner axial thickness and a radially inside second section with a thicker axial thickness are formed by the indentation on the circumferential rim.

9. The fan according to claim 8, wherein the axial thickness of the first section of the circumferential rim is between 225% and 90% of the axial thickness of the second section of the circumferential rim, and/or the radial width of the first section of the circumferential rim is between 15% and 85% of the radial thickness of the circumferential rim.

10. A motor vehicle that has a fresh air intake and a fan according to claim 1, wherein the fan is downstream of the air intake in the airflow.

11. A fan for a motor vehicle, comprising a fan wheel that rotates about a rotational axis, and a frame that supports the fan wheel, the fan wheel comprises a circumferential outer ring spaced apart from the rotational axis, and the frame comprises a circumferential rim segment spaced apart from the outer ring, the circumferential outer ring on the fan wheel comprises a circumferential rim that is perpendicular to the rotational axis and extends outward therefrom, wherein the circumferential rim segment on the frame at least partially lies axially opposite the circumferential rim on the outer ring, and the circumferential rim segment on the frame comprises at least one recess that forms a pocket, which is open toward the circumferential rim on the outer ring, wherein the circumferential rim on the circumferential outer ring of the fan wheel has a circumferential, stepped indentation on the surface facing away from the recesses in the circumferential rim segment and perpendicular to the rotational axis, the stepped indentation is at a constant geometry around the circumference of the circumferential rim, and a radially outside first section with a thinner axial thickness and a radially inside second section with a thicker axial thickness are formed by the indentation on the circumferential rim.

12. The fan according to claim 11, wherein the at least one recess in the circumferential rim segment is downstream of the circumferential rim on the outer ring of the fan wheel and is disposed in the airflow conveyed by and flowing through the fan wheel when the fan is operating.

13. The fan according to claim 11, wherein the circumferential rim segment on the frame comprises a circumferential outer wall that is parallel to the rotational axis, a circumferential inner wall that is parallel to the rotational axis, and a circumferential floor that is perpendicular to the rotational axis, wherein the outer wall is radially outside and spaced apart from the inner wall, and the floor connects the outer wall to the inner wall, such that a circumferential groove is formed in the circumferential rim segment on the frame and is spaced apart from the rotational axis, and wherein the at least one recess in the circumferential rim segment is in the groove.

14. The fan according to claim 13, wherein the circumferential rim segment on the frame has a plurality of recesses that are distributed evenly about the rotational axis, and wherein adjacent recesses that are in the groove are separated by walls therein.

15. The fan according to claim 13, wherein an axial extension of the inner wall of the circumferential rim segment is smaller than an axial extension of the outer wall of the circumferential rim segment, the axial extension of the of the inner wall of the circumferential rim segment is between 15% and 95% of the axial extension of the outer wall of the circumferential rim segment, and/or the radial extension of the floor of the circumferential rim segment is between 35% and 120% of the axial extension of the inner wall of the circumferential rim segment.

16. The fan according to claim 13, wherein the outer wall of the circumferential rim segment is at least partially radially opposite the rim on the circumferential outer ring.

17. The fan according to claim 11, wherein the inner segment on the frame comprises a circumferential groove spaced apart from the rotational axis, the inner segment on the frame has a plurality of recesses that are distributed about the rotational axis in the groove, and adjacent recesses in the groove are separated by walls therein.

* * * * *